United States Patent [19]

Chavez et al.

[11] Patent Number: 4,937,772

[45] Date of Patent: Jun. 26, 1990

[54] MICROCOMPUTER-IMPLEMENTED METHOD AND APPARATUS FOR AIDING BOWLERS

[76] Inventors: Leroy R. Chavez, 4047 Gion Ave., San Jose, Calif. 95127; William B. Sadler, 2866 Via Carmen, San Jose, Calif. 95124

[21] Appl. No.: 153,986

[22] Filed: Feb. 9, 1988

[51] Int. Cl.[5] ..... G06F 15/44; A63D 5/00

[52] U.S. Cl. ..... 364/715.01; 273/54 C; 364/410; 434/249

[58] Field of Search ..... 364/410, 411, 700, 705.01, 364/715.01; 434/249; 273/37, 54 R, 54 B–54 E

[56] References Cited

U.S. PATENT DOCUMENTS

| | | | |
|---|---|---|---|
| 3,081,559 | 3/1963 | Kaminsky | 434/249 |
| 3,250,535 | 5/1966 | Patterson et al. | 273/54 D |
| 3,279,097 | 10/1966 | Tomblin, Jr. | 273/54 BA |
| 3,284,928 | 11/1966 | Kelley | 273/54 BA |
| 3,460,832 | 8/1969 | Blewitt, Jr. | 273/54 D |
| 3,841,633 | 10/1974 | Walsh et al. | 273/54 D |
| 4,008,893 | 2/1977 | Yoseloff | 273/37 |
| 4,035,931 | 7/1977 | Burger | 434/249 |
| 4,339,128 | 7/1982 | Multner | 273/54 D |
| 4,607,843 | 8/1986 | Signoretti | 434/249 |
| 4,776,801 | 10/1988 | Summers | 434/249 |

FOREIGN PATENT DOCUMENTS 59-2773 1/1984 Japan .

*Primary Examiner*—Dale M. Shaw
*Attorney, Agent, or Firm*—Dulin Law Firm

[57] ABSTRACT

The present invention provides a portable microcomputer-implemented bowling aid which indicates to the bowler (i) correct starting position and (ii) correct board marker over which to roll the ball after its released so as to maximize pin count with minimum data entry problems.

In accordance with one aspect of the present invention, the bowler first inputs game parameters such as right- or left-handness through I/O elements to a RAM of a microcomputer operationally connected to a bowling alley replica display. The replica display includes representations of (a) triangularly configured pins 1, 2, 3, . . . 10, (b) the bowling lane, (c) the foul line, (d) a series of board markers or spots adjacent to the foul line but on the pin side thereof and (e) a series of foot positions to the start of the bowler's approach to delivery of the bowling ball. The representations related to (a), (d) and (e) are keyed together by programing steps. As a result, control signals are generated by the microcomputer to control a logic driver circuit in series with LEDs of (d) and (e), supra. However, the drive current for the LEDs is not sourced from within the microcomputer. The algorithm for operations is in ROM stepped through operations by the CPU within the microcomputer.

10 Claims, 9 Drawing Sheets

| | | | | | | | | | | |
|---|---|---|---|---|---|---|---|---|---|---|
| FOREMOST PIN | 1 | 2 | 3 | 4 | 5 | 6 | 7 | 8 | 9 | 10 |
| FOOT BOARD | 14 | 11 | 25 | 9 | 17 | 25 | 5 | 9 | 26 | 32 |
| BOARD MARKER | 10 | 10 | 15 | 15 | 10 | 15 | 15 | 15 | 15 | 15 |

LATCH TRUTH TABLE

| D | G | Q | $\bar{Q}$ |
|---|---|---|---|
| H | L | L | L |
| L | L | H | $\bar{Q}_o$ |
| H | H | $\bar{Q}_o$ | $\bar{Q}_o$ |
| L | H | $\bar{Q}_o$ | $\bar{Q}_o$ |

FIG. 8b
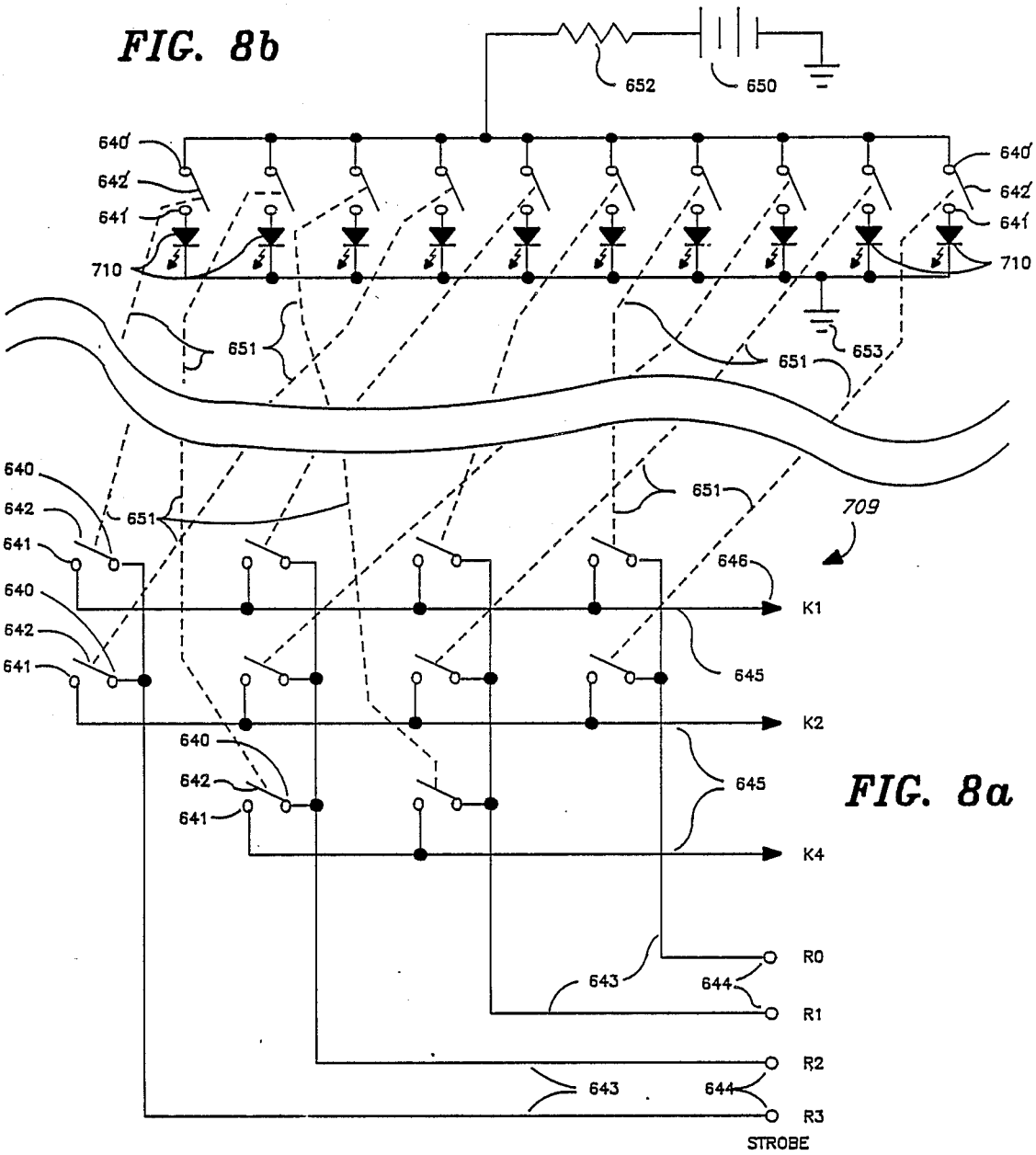
FIG. 8a
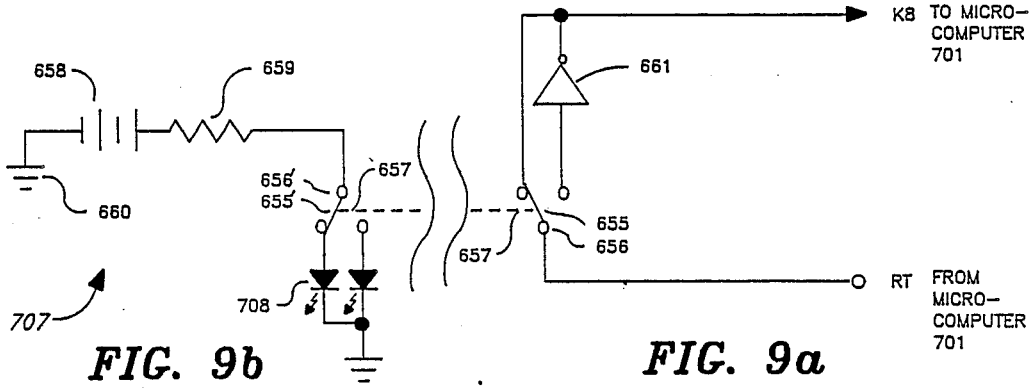
FIG. 9b
FIG. 9a

| FOREMOST PIN | 1 | 2 | 3 | 4 | 5 | 6 | 7 | 8 | 9 | 10 |
|---|---|---|---|---|---|---|---|---|---|---|
| FOOTBOARD (RIGHT) | 15 | 11 | 25 | 9 | 17 | 25 | 5 | 9 | 26 | 32 |
| BOARD "SPOT" (RIGHT) | 10 | 10 | 15 | 15 | 10 | 15 | 15 | 15 | 15 | 15 |
| FOOTBOARD (LEFT) | 25 | 29 | 15 | 31 | 23 | 15 | 35 | 31 | 14 | 8 |
| BOARD "SPOT" (LEFT) | 30 | 30 | 25 | 25 | 30 | 25 | 25 | 25 | 25 | 25 |

MICROCOMPUTER-IMPLEMENTED METHOD AND APPARATUS FOR AIDING BOWLERS

CROSS REFERENCE TO RELATED APPLICATION

This application is related to Ser. No. 387,195 filed June 10, 1982, for "APPARATUS FOR TEACHING BOWLING", Leroy R. Chavez and William B. Sadler, later unavoidably abandoned for failure to pay the final fee and now being petitioned to be restored to the pending files, and the Japanese counterpart Ser. No. 59-2773 filed June 2, 1983 and laid open to inspection on Dec. 10, 1983. If successful, this application is a continuation-in-part thereof; if not, it is still patentably distinct.

This invention relates in general to bowling and more particularly to a microcomputer-implemented method and apparatus in digital (not analog) format for generating visual information for aiding a bowler to convert a spare of a particular configuration of bowling pins keyed to most prominent, up-alley standing pin.

In accordance with one aspect of the present invention, the bowler first inputs game parameters such as right- or left-handness through I/0 elements to a RAM of a microcomputer operationally connected to a bowling alley replica display. The replica display includes representations of (a) triangularly configured pins 1,2, 3 ... 10, (b) the bowling lane, (c) the foul line, (d) a series of board markers or spots adjacent to the foul line but on the pin side thereof and (e) a series of foot positions to the start of the bowler's approach to delivery of the bowling ball. The representations related to (a), (d) and (e) are keyed together by a microcomputer based on the determined standing pin nearest the bowler. As a result, the microcomputer generates control signals via a bus to control a logic driver circuit in series with LEDs of (d) and (e). The drive current for the LEDs is not sourced from within the microcomputer, however. The data is then visually indicated by the enabled LEDs, and achieves the features set forth above. The algorithm for operations is in ROM stepped through operations by the CPU of the microcomputer.

DEFINITIONS:

There are certain terms used in the instant application that are in need of further clarification as set forth below.

(a) ASCII is the symbols and characters for code adopted as the American Standard Code for Information Interchange.

(b) ADDER is sub-block within the microcomputer for providing a sum and a carry when two numbers are added.

(c) ADDRESS is a binary number designating the location in RAM or ROM.

(d) ALGORITHM is a set of steps by which a given result is obtained.

(e) ALU is the arithmetic and logic sub-block within the CPU of the microcomputer that performs any of the number of arithmetic and logic operations on words related to determining standing and pin configurations, foot positions, spot locations in which addition, subtraction, comparison and AND and OR functions are performed.

(f) ANALOG CIRCUITRY is linear circuitry in which certain properties of electricity (voltage, current, amplitude and frequency of waves or pulses) continuously and smoothly vary with time over a certain range rather than switching suddenly between levels.

(g) AND gate is a circuit or device with two or more input of binary data and one output whose output is ONE only when all the inputs are ONE. The output is ZERO when any one or more inputs are ZERO.

(i) BASIC means Beginner's All-purpose Symbolic Instruction Code that is a high-level language developed to be easy to use and easy to learn.

(h) BINARY-CODED-DECIMAL (BCD) CODE is binary numbering system in which each digit of a decimal number is represented in groups of four bits.

(i) BINARY NUMBERING CODE is a procedure of writing numbers by representing each numbers using two digits, ONE, ZERO) wherein each position for a bit represents a column running 1, 2, 4 8, 16 etc.

(j) BIT is the smallest possible piece of data, viz., a ONE or a ZERO.

(k) BRANCH is a portion of the steps in the method of present invention where either of two possible steps may be selected for the next step.

(l) BUFFER is a digital circuit with one input and one output used to strengthen a weak signal.

(m) BUS is two or more conductors running in parallel used for carrying data.

(n) BYTE is a group of adjacent bits for transmitting and receiving data that makes up a digital word.

(o) CIRCUIT is a path for electricity from one terminal of a power source through conductors and devices and back to the other terminal of the source.

(p) CLOCK INPUT is an input terminal of a sub-block for receiving a timing control-clock signal from the CPU but can be used for other purposes.

(q) CLOCK GENERATOR is a sub-block of the microcomputer that generates clock signals.

(r) CODE is a set of rules assigned to a group of bits that performs a certain function following certain rules.

(s) CODE CONVERTOR is a sub-block of the microcomputer or of a device that converts one code and transits the same information in the converted code with respect to one particular code. The device that converts to the particular code is called a encoder; the device that converts from that code is called a decoder.

(t) LOGIC GATES is a group of logic gates that does not store data but outputs certain combinations as a function of inputs.

(u) COMPARATOR is a device or a sub-block of the microcomputer that compares two binary numbers or two signals and outputs are indicative of which is greater less or equal to the other.

(v) CONTROLLER is a device or a sub-block of the CPU that selects generates control signals based on a set of conditions or functions entered into the controller.

(w) COUNTER is a special type of register or series of flip-flops with an input and parallel outputs in which each output is a certain count of pulses and stores the count in a certain code.

(x) COMPILER is a program that prepares a machine language program from a program written in a higher-level language.

(y) CPU is a section of the microprocessor consisting of controller, registers, ALU, and storage means and performs arithmetic operations, controls instructions, processing and provides timing signals.

(z) D FLIP FLOP is a clocked flip-flop with a D input whose ONE output changes as a function of the clocked signal to the G input, to the state maintained at D.

(aa) DATA SELECTOR is a device or sub-block of the microcomputer that routes data from several input to a single output according to the state of a control signal generated by the microcomputer.

(bb) DECODER is a device or sub-region of the microcomputer that receives several inputs and "recognizes" one or more combinations of inputs and outputs a signal when the correct combination occurs.

(cc) DEMULTIPLEXER is a device or sub-region of the microcomputer that routes data to one of several outputs as a function of control signals.

(dd) DOUBLE POLE SINGLE THROW SWITCH (DPST) includes two sets of poles and two contacts controlled by single contact movement.

(ee) DIGITAL DATA is data in pieces or bits.

(ff) DIODE is a device that rectifies current so as to allow C passage in only one direction.

(gg) DRIVER is a circuit that provides digital signals with enough power to drive something other than near gates such as LEDs of a display.

(hh) EXCLUSIVE-OR GATE is a device with two inputs of binary data and one output whose output is ONE when either input is ONE and the output is ZERO when neither or both inputs are ONE.

(ii) FLIP-FLOP is a device having two stable states that stores one bit by means of two gates cross-coupled as a latch, changing from one state to the other by a control signal but remains in that state from the control signal is removed. That is, on command from a control pulse, the device stores (holds or remembers) at its output a bit of data (ONE or ZERO) at the input.

(jj) TRUTH TABLE is a description of the operations of a device or circuit in which the output is a function of different input states.

(kk) LOGIC GATE is an AND, OR, NOT, NAND, NOR or EXCLUSIVE-OR device.

(ll) INDEXED ADDRESS is an address modified by the content of a index register prior to or during the execution of a computer instruction.

(mm) INSTRUCTION is a series or string of bits in a certain combination stored in a microprocessor system that tells the system what to do next.

(nn) LATCH is a device with input, an output and a control signal that makes the output either follow the input or be held in its present state.

(oo) LED is a semiconductor two terminal "light bulb" made of semiconductor material such as gallium phosphide that makes light when current is passed through it in a particular direction.

(pp) MEMORY is a sub-region of the microprocessor system where data is stored.

(qq) MICROCOMPUTER is a computer in the lowest range of size and speed..it contains a CPU, stored instruction in ROM, a RAM memory for data and instruction and I/0 circuits.

(rr) MICROPROCESSOR SYSTEM is a series of integrated circuits that can be programmed to perform a variety of functions consisting of at least a controlled, registers and an ALU (i.e., basic parts of a CPU).

(ss) MODULUS of a counter is the number of states it counts through before resetting.

(tt) NOR gate is an OR gate followed by an invertor.

(uu) NEGATIVE LOGIC means the decision to let the more negative of the two signal levels to represent ONE.

(vv) REGISTER is a certain type of temporary storage of data such a shift register and a parallel register.

(ww) RAM is a random-access memory where words may be "written" (store) or "read" (recovered) in any order.

(xx) ROM is a read only-memory containing a program or data permanently stored when the system was made.

(yy) SEGMENT is one of the seven bars in rectangular figure-8 display.

(zz) SOURCE PROGRAM is a set of instructions written in a high-level or in assembly language as opposed to machine language.

(aaa) STATE means the logic state of a conductor in a C digital circuit.

(bbb) SUBROUTINE means a routine that is part of another routine.

(ccc) WORD is a group of bits handled as a unit and usually stored at a certain address.

BACKGROUND

Bowling is a very popular participant sport enjoyed by young and old alike. Almost every bowler would like to improve this or her average score, and a most important aspect to any improvement is be taught the proper foot starting positions and the proper lane marker or spot over which the ball should be rolled.

A number of prior art patents address the above mentioned problems with mechanical devices that can be used to indicate proper starting foot positions and board markers. For example, in U.S. Pat. No. 3,374,557 of Lotarius a game guide is described including a base member imprinted with the representation of bowling alley, and a transparent overlay having a plurality of straight lines imprinted on it. The overlay is moved across the surface of the base member to indicate various relationships between the target pins, the board markers, and foot starting positions.

In U.S. Pat. No. 3,445,032 of Vail an aid for spot bowlers is disclosed including a rectangular plastic card having the representation of a bowling alley printed on its upper surface, a sliding cover engaged with the card, and an arcuate pointer supported on a pintle that extends between the card and the cover. The front end of the pointer can be positioned next to the pin formation indices on the base card, and the rear end of the pointer suggest an approach path to the foul line.

In Pat. No. 3,279,097 of Tomblim, a bowler's slide rule is described including a base portion having the image of a bowling alley printed on its top surface, and a clear strip adjustable attached to the base having both a straight and a curved line imprinted upon it. The base and the clear strip are attached together by a clamp riding in a pair of slots provided in the base and the strip. The clear strip is manipulated to indicate various starting positions and board markers.

In U.S. Pat. No. 3,250,535 of Patterson et al, the bowling ball path indicator display at the far end of the lane is modified to include five-to-seven lamps across the bottom of the display. The lamps are representative of the five-to-seven lane markers individually driven with the generation of the different arrows of the path lamp display.

Many of the above-described aids for the individual bowler, are cumbersome to use and present the bowler with difficult data entry problems. Where such aids employ co-acting mechanical paris, speed of data generation is also slow. Additionally, they must be coordinated with other information ordinarily provided to the bowler but the significance of which is not understood by the beginning or intermediate bowler. For example, the mechanical devices described above require that the bowler know which pin he should aim for. Furthermore, circuit improvements related to the bowling path display at the bowling alley, can only be used if the owners of the bowling alleys choose to implement them. Furthermore, they still require a degree of judgement and knowledge that a beginning or intermediate bowler may not have. For example, they require that the bowler's start foot positions also be known. Since the bowler may not know where to start, he or she may direct the ball to the wrong pin. Still further, none include a microcomputer for operations in association with a portable replica of the actual bowling alley as described hereinafter.

SUMMARY

The present invention provides a microcomputer-implemented bowling aid which indicates to the bowler (i) the correct foot starting position and (ii) the correct board marker over which to roll the ball after its release so as to maximize pin count with minimum data entry problems.

In accordance with one aspect of the present invention, the bowler first inputs game parameters such as right- or lefthandness through I/0 elements to a RAM of a microcomputer operationally connected to a bowling alley replica display. The replica display includes representations of (a) triangularly configured pins 1, 2, 3 ... 10, (b) the bowling lane, (c) the foul line, (d) a series of board markers or spots adjacent to the foul line but on the pin side thereof and (e) a series of board markers or spots adjacent to the foul line but on the pin side thereof and (e) a series of foot positions to the start of the bowler's approach to delivery of the bowling ball. The representations related to (a), (d) and (e) are keyed together by the microcomputer to control a logic driver circuit based on the up-alley forestanding pin nearest the bowler. As a result, the microcomputer generates control signals via a bus to control the driver circuit and hence enable LEDs of (d) and (e). The drive current for the LEDs is not sourced, however, within the microcomputer. The algorithm for operations is in ROM stepped through operations by the CPU of the microcomputer.

Total I/0 requirements of the present invention are as follows:

(a) Inputs are a power-on switch functioning also as a new game switch, bowler delivery arm switches (right or left) and a set of switches arranged as a triangular "10-pin" configured keyboard to input number and position of the standing pins; and (b) Outputs include the series of control signals generated by the microcomputer to control the logic driver circuit whereby certain of the associated LEDs are enabled to indicate "correct" foot and aiming marker ("spot") positions on the bowling alley display to convert a particular configuration of standing pins previously entered into the microcomputer.

Entry of the data occurs as the set of switches in (a), supra, is scanned for closure. Next, the microcomputer transforms the entered pin configuration to a single standing upalley pin as representative of the group and generates control signals to the driver logic circuit based on indexed addressing instructions or equivalent logic steps associated with look-up table instructions.

Further features of the present invention will become more apparent upon consideration of the following detailed descriptions of preferred embodiments when taken in connection with the accompanying drawings.

Figure 6:
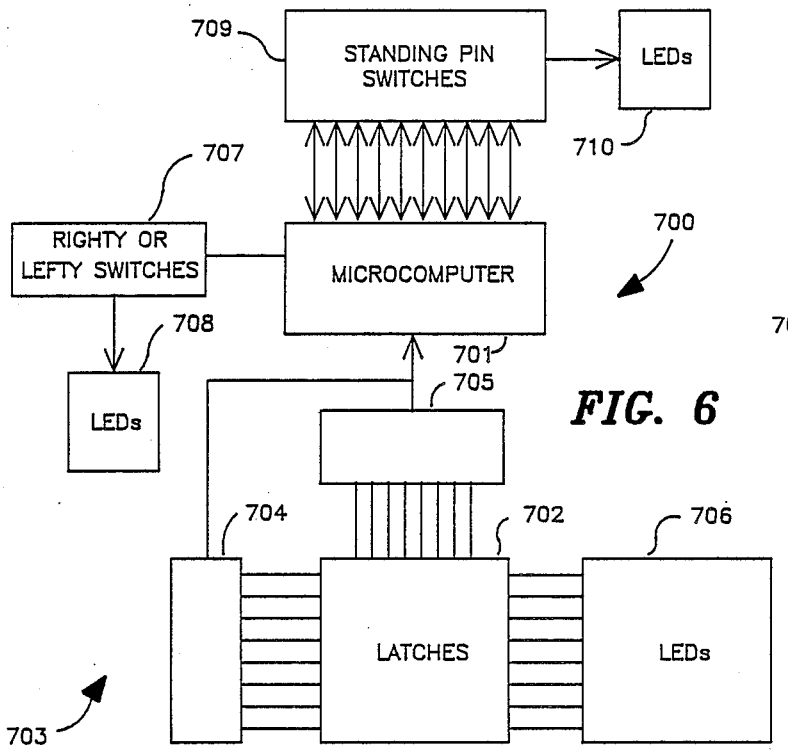
FIG. 6 is a block diagram of the improved microcomputer-implemented bowling apparatus and system of the present invention.
Figure 7B:
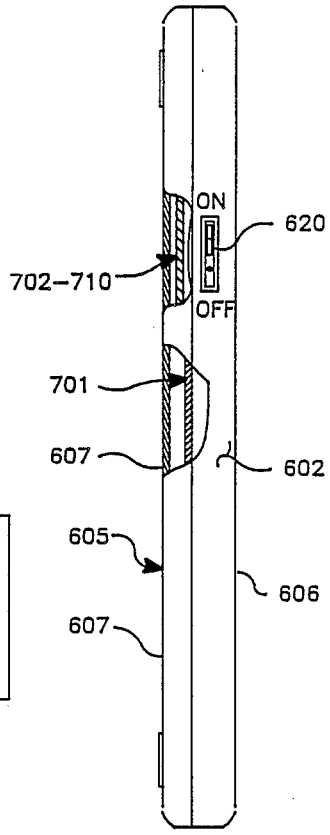
Figure 7A:
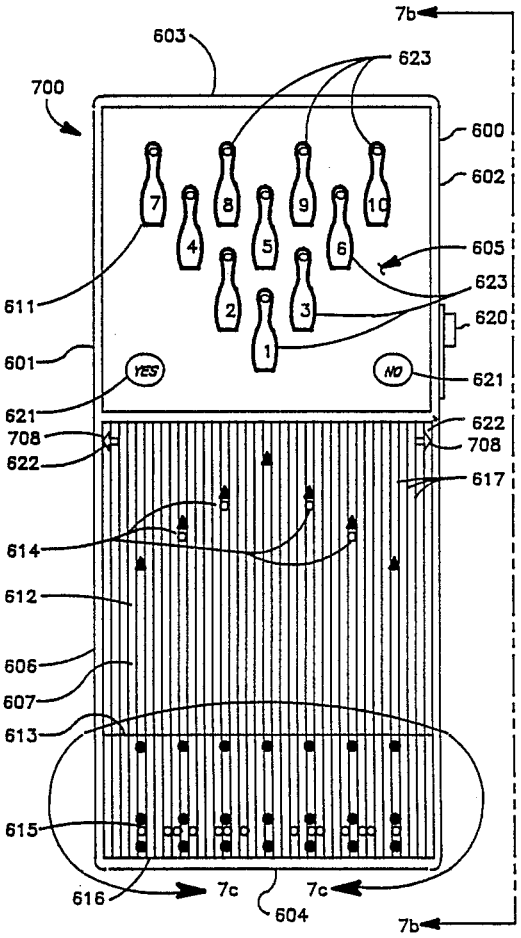
Figure 7C:
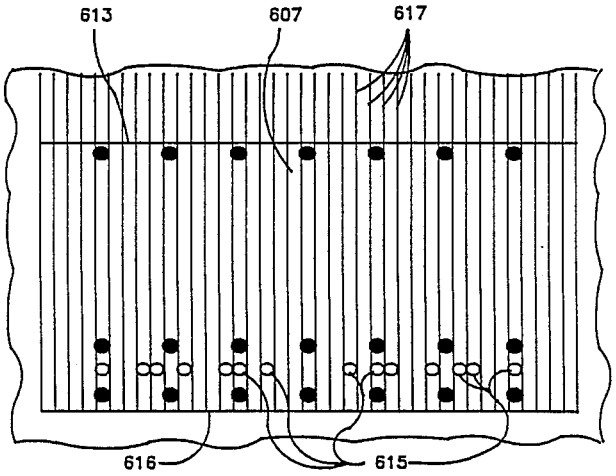
Figure 10:
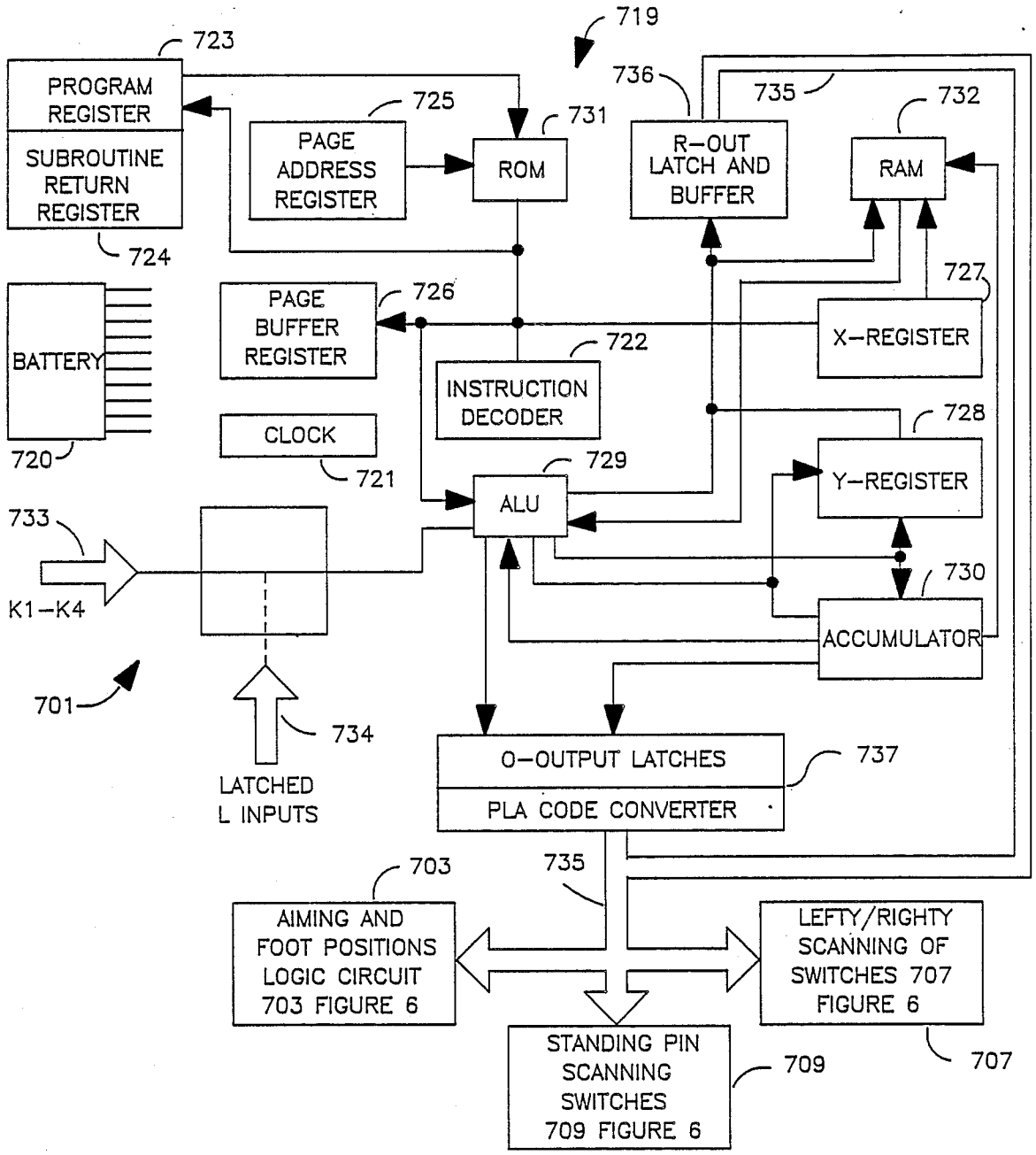
Figure 11A:
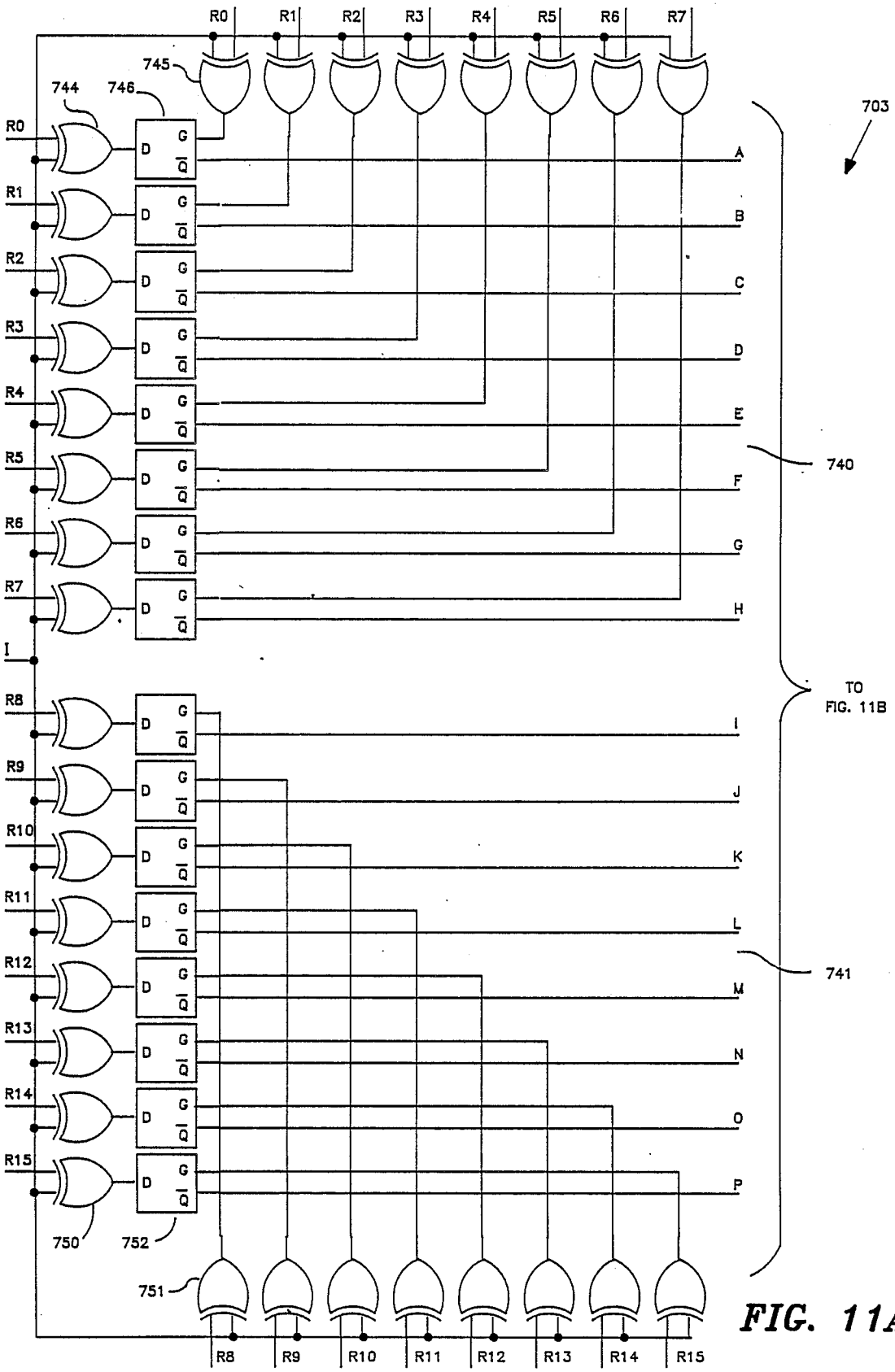
Figure 11B:
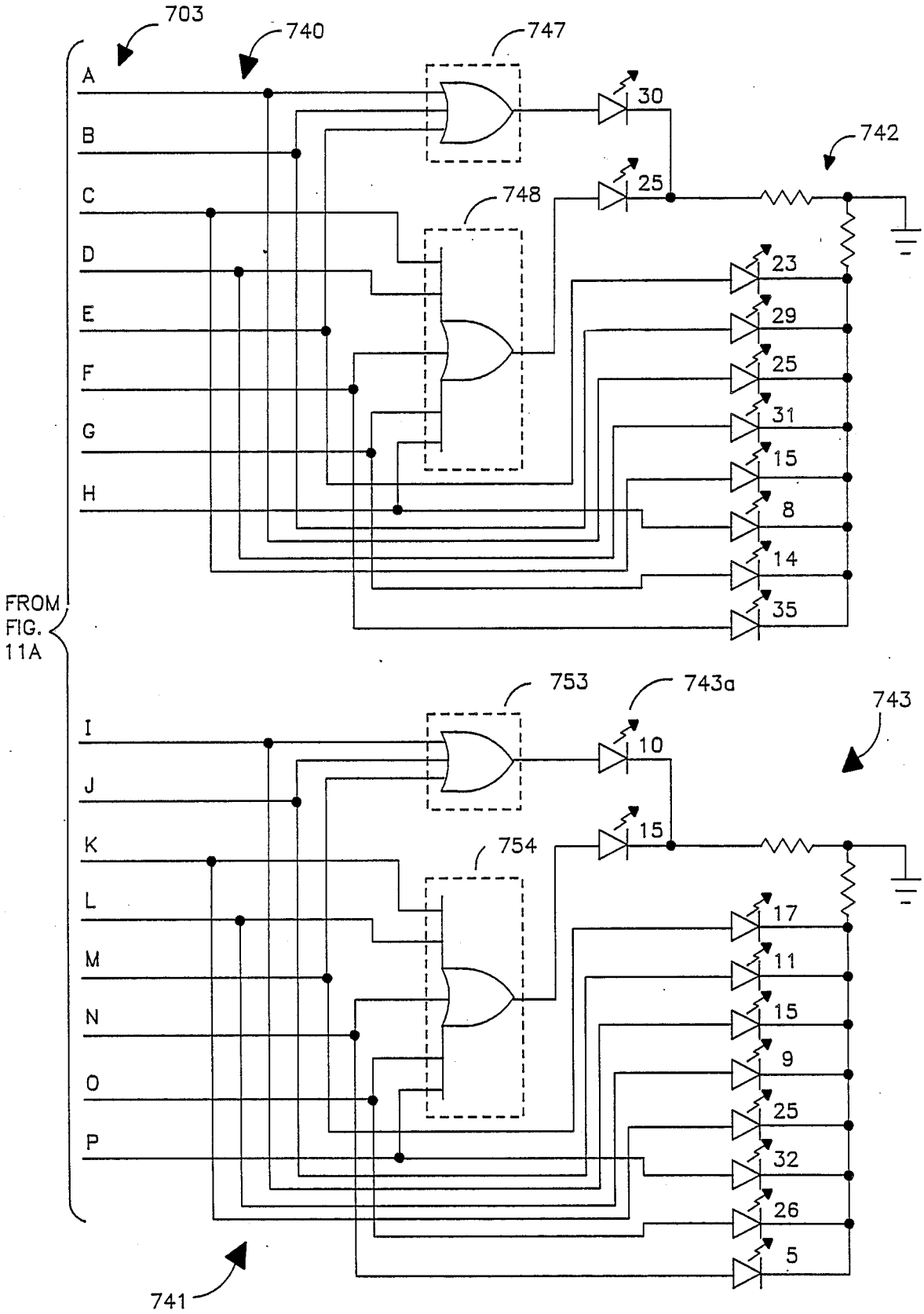
Figures 12, 13:
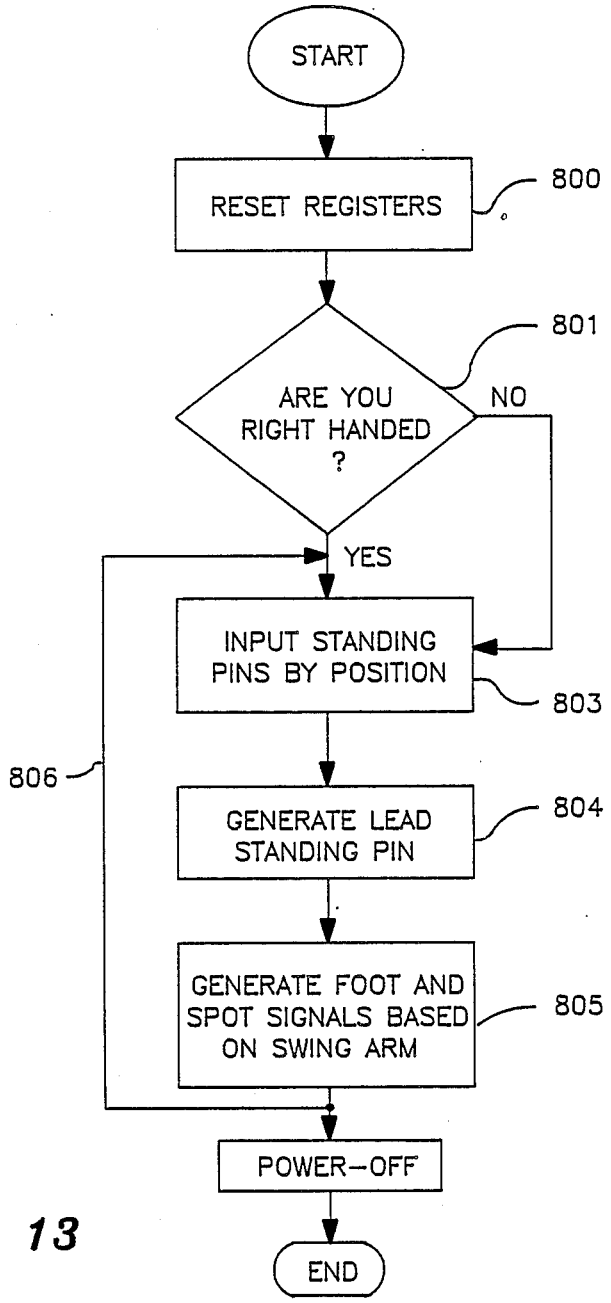

FIGS. *7a*, *7b* and *7c* are a plan, side and detail view of an enclosure for supporting the improved microcomputer-implemented bowling apparatus and system of FIG. 6;

FIGS. *8a*, *8b*, and *9a*, *9b* are circuit diagrams of switch circuits used in the apparatus and system of FIGS. 6, *7a* and *7b*;

FIG. 10 is a block diagram of a microcomputer of the apparatus and system of FIG. 6;

FIGURES 11*a* and 11*b* are block diagrams of a logic driver circuit of the apparatus and system of FIG. 6;

FIG. 12 is a table indicating the relationship between foremost standing pin, start foot position and aiming marker location on an actual bowling alley lane;

FIG. 13 is a flow diagram of operations of the apparatus and system of FIG. 6.

DETAILED DESCRIPTION OF BEST MODE

The following detailed description illustrates the present invention by way of example only and not lay way of limitation of its principles. This description will clearly enable one skilled in the art to make and use the invention and describes several embodiments, adaptations, variations, alternatives and uses of the invention, as well as its operating principles, including what is presently believed to be the best mode for carrying out the invention.

Before describing the present microcomputer-implemented system perhaps a brief review of a pair of hard-wired bowling devices is in order and is presented below with reference to FIGS. 1–5.

NON-MICROPROCESSOR EMBODIMENTS

Figure 1:
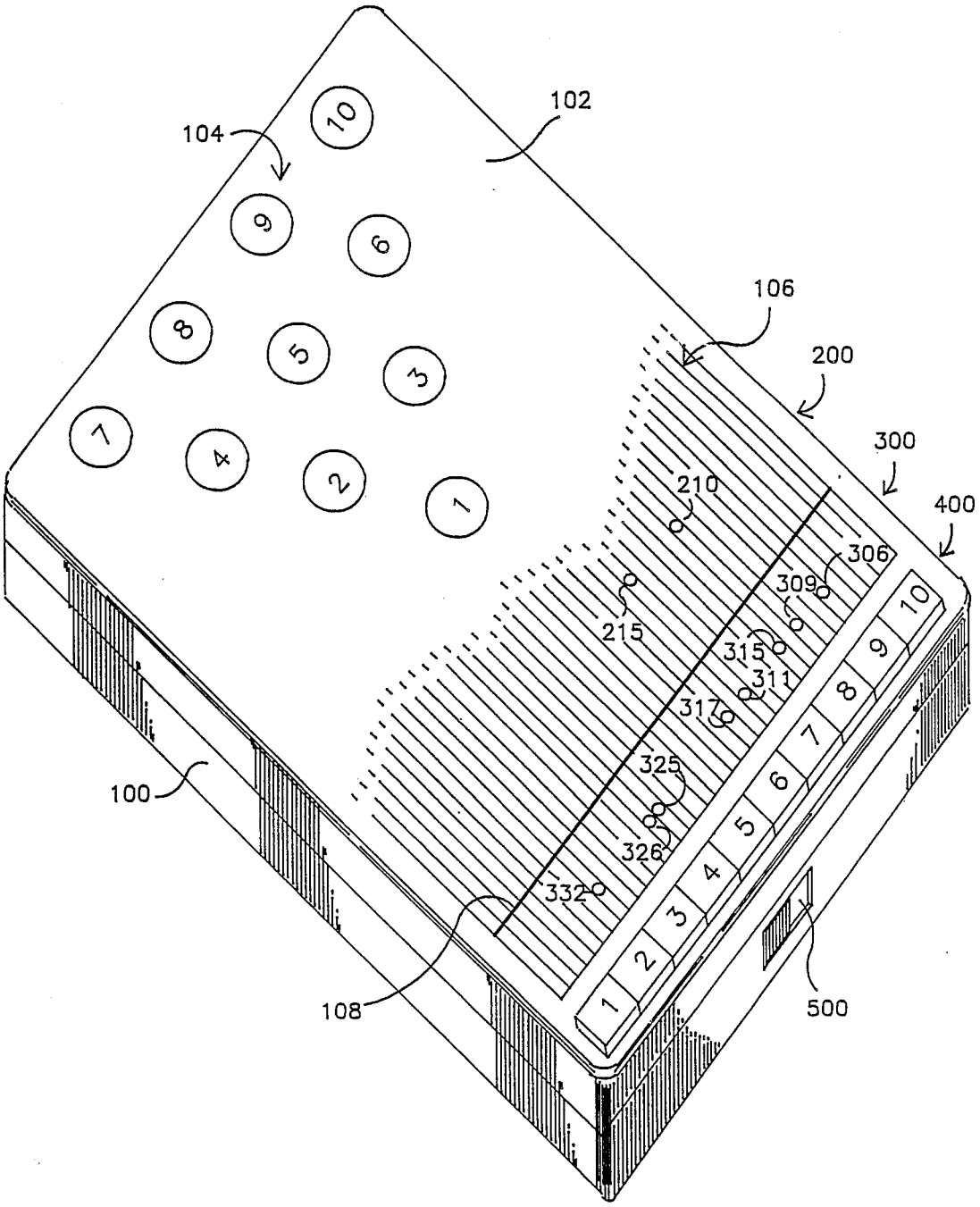
FIG. 1 is a perspective view of the outer enclosure of a bowling teaching device.
Figures 2, 3:
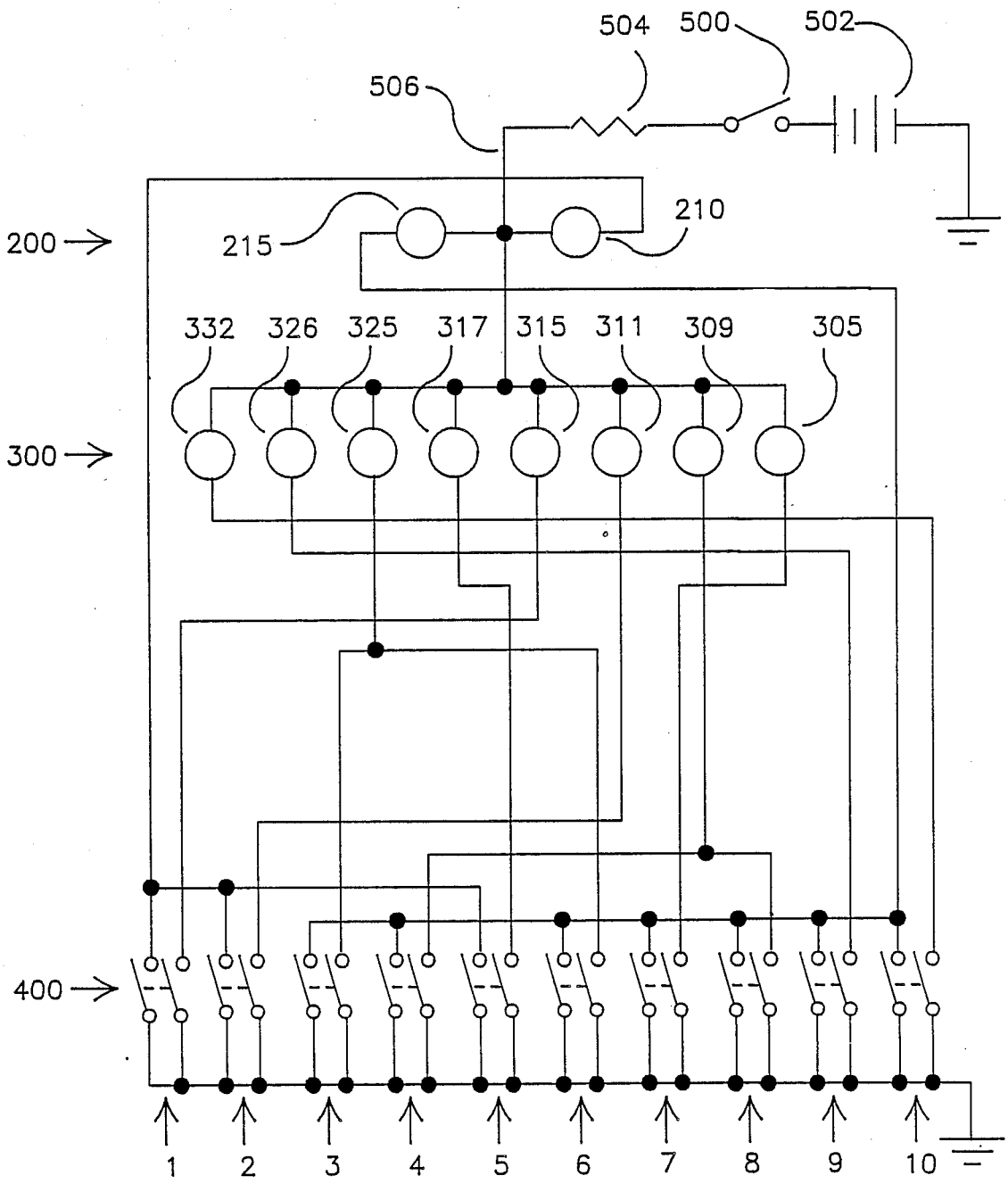
FIG. 2 is a schematic of the circuitry of the bowling teaching device of FIG. 1.
FIG. 3 is a table indicating the relationship between the foremost standing pin position and the proper foot and board marker position. These relationships are embodied in the schematic of FIG. 2.

Briefly, in FIGS. 1–3 an analog circuit is provided with a series of 1-in-10 double pole, single throw switches that are selectively enabled to connect a power source to drive both (a) 1-in-8 light bulbs associated with foot positions representations on a bowling alley display replica, and (b) 1-in-2bulbs related to corresponding aiming marker representations on the same replica. As the contacts on the 1-in-10 switches are closed by the bowler, current flows to (a) and (b) to show where the bowler is to stand and aim to convert a particular pin configuration. But current flow ceases when the bowler releases his fingers from the 1-in-10 switches.

Figures 4, 5:
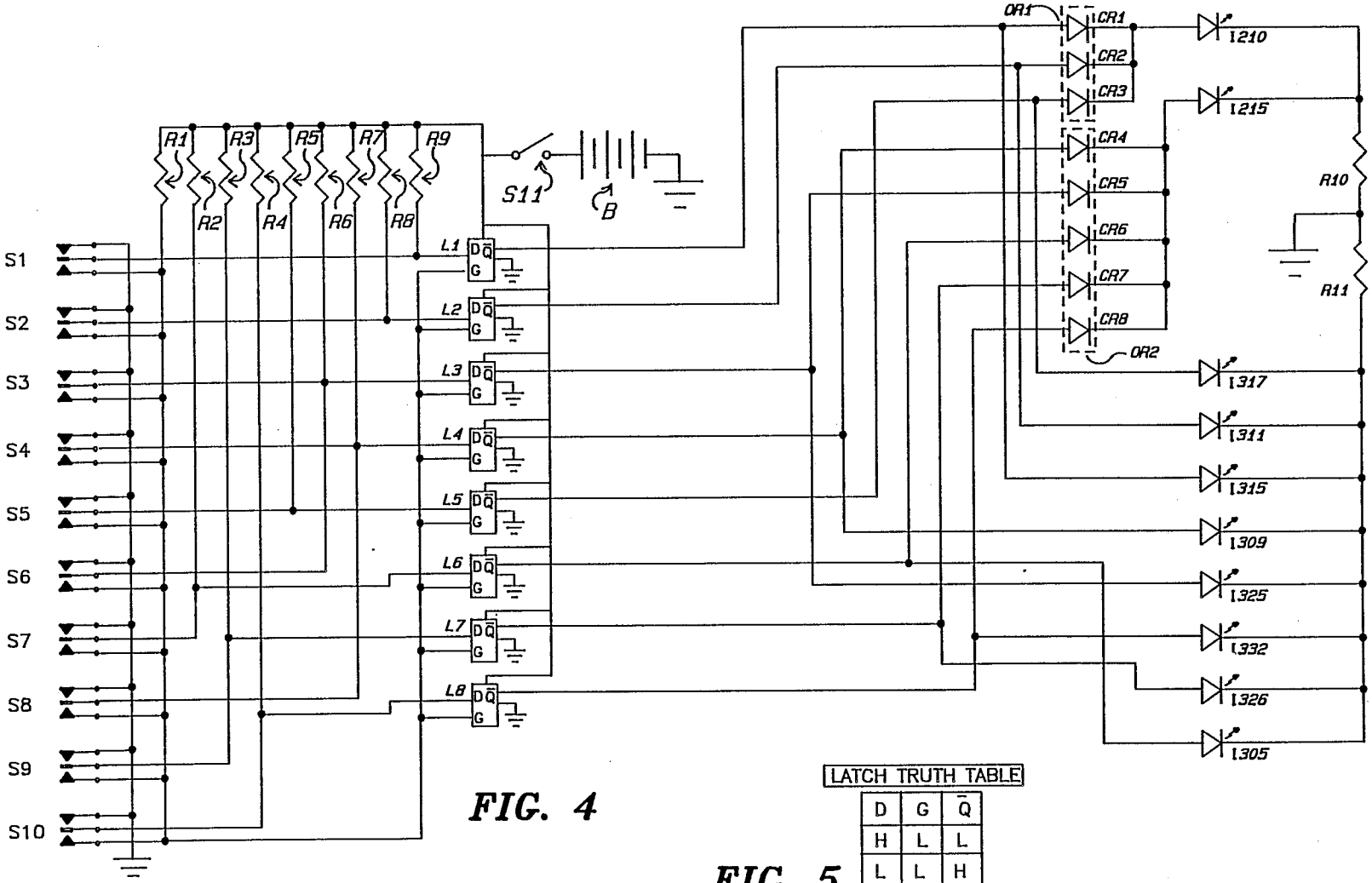
FIG. 4 is a schematic of the circuitry for a second device.
FIG. 5 is a truth table for the electronic latches shown in FIG. 4.

In FIG. 4, a series of sequentially grounded 1-in-10 switches are activated by the bowler based on a particular standing pin configuration. Each such switch has three different levels of activation wherein through the up-down movement of the contacts drive associated 1-in-8 latches. The outputs of the latches are then used to drive in turn a series of LEDs positioned on the bowling alley replica. As a result, the bowler is guided as to where to stand and aim to convert a particular pin configuration. But since the latch remains activated even though the switch contacts are released, the LEDs remain enabled until a new frame sequence occurs. But activation is based on a full, even contact during the up-down sequence of 1-in-10 switches by the bowler. If the contacts become worn or the updown, sequence is too fast the driving current may not be accurately generated.

Referring to FIG. 1, bowling calculator teaching device 99 includes a case or enclosure 100 provided with a first row of indicator lights 200, a second row of indicator lights 300, a row of selector switches 400, and an on/off switch 500. The numbering system used in this description is designed to minimize confusion with the standardized numbering system used on bowling alley lanes.

Enclosure 100 has a top surface 102 provided with indicia representative of a bowling alley lane. The indicia includes ten number symbols 104 representing the ten pin positions at the end of a bowling alley lane. Forty parallel lines 106 are used to indicate the thirty-nine boards of a bowling alley lane, and a line 108 represents the foul line. The thirty-nine boards are counted from one to thirty-nine starting at the right of the figure and proceeding to the left.

The first row of lights 200 includes two lights 210 and 215. Light 210 is centered on board 10 of the lane and light 215 is centered on board 15 of the lane. Lights 210 and 215 represent the board markers that a bowler should roll his ball over.

The second row of lights 300 includes eight lights 305, 309, 311, 315, 317, 325, 326, 332 corresponding to boards 5, 9, 11, 15, 17, 25, 26, and 32, respectively, of a bowling alley lane. The lights 305–332 represent the board upon which the right handed bowler should place his left foot prior to making his foul line approach. The lights 210–215 and 305–332 can be of any suitable type including incandescent and light emitting diode.

The row of selector switches 400 includes ten push buttons switches numbered 1–10. the numbered switches correspond to the pin positions of the bowling alley as represented on the enclosure at 104.

Referring now to FIG. 2, circuitry of FIG. 1 will be discussed. A small dry cell battery 502 supplies the power for the device 99 and a resistor 504 provides current limitation. Switch 500, mentioned earlier, switches the power off and on for the device.

A lead from each of lights 210, 215, and 305–332 is coupled to resistor 504 by a line 506. The other lead of each of the lights is coupled by conductors to one of switches 1–10.

Switches 1–10 are DPST (Double Pole Single Throw) switches. One of the poles of each of the switches is used to selectively ground one of lights 210 and 215, and the other pole of each of the switches is used to selectively ground one of lights 305–332. More specifically: for switch one, a first pole is coupled to light 210 and a second pole is coupled to light 315; for switch 2, a first pole is coupled to light 210 and a second pole is coupled to light 311; for switch 3, a first pole is coupled to light 215 and a second pole is coupled to light 325; for switch 4, a first pole is coupled to 215 and a second pole is coupled to light 309; for switch 5, a first pole is coupled to light 210 and a second pole is coupled to light 317; for switch 6, a first pole is coupled to light 215 and a second pole is coupled to light 325; for switch 7, a first pole is coupled to light 215 and a second pole is coupled to light 305; for switch 8, a first pole is coupled to light 215 and a second pole is coupled to light 309; for switch 9, a first pole is coupled to light 215 and a second pole is coupled to light 326; and for switch 10, a first pole is coupled to light 215 and a second pole is coupled to light 332. Thus, the activation of one of switches 1–10 causes one of the row 200 lights to illuminate and one of the row 300 lights to illuminate.

The operation and theory of the bowling device 99 will be discussed with reference to FIG. 3.

First, a bowler determines the number of the foremost standing pin at the end of the alley. For example, if none of the pins are knocked down the foremost standing pin is one, and if all but pins 7, 4, and 10 are knocked down the closest standing pin number is 4. The bowler then presses the switch number corresponding to the closest standing pin. For the above examples, the bowler would press switch 1 if all the pins were standing and switch 4 if pins 7, 4, and 10 were standing. As described earlier, the activation of a switch will illuminate lights to indicate to the bowler a proper foot starting position and what the proper foot marker position will be.

The relationships between the foremost pin, the foot board starting position, and the board marker position are listed in the table of FIG. 3. These relationships were determined empirically from years of experimentation by an experienced bowler, and seem to hold very well for the great majority of bowlers despite variations in individual style. However, alternate embodiments of this invention may have different relationships wired into the calculator. The wiring of the lights and switches can be accomplished by a plug board or any other easily changed method so the bowler can modify the device to better suit his individual game.

The embodiment described above is designed for right handed bowlers. A left handed version can also be produced, or a left handed bowler can simply count the boards from the left rather than from the right.

In FIG. 4, an electronic embodiment is shown to include eleven switches S1–S11, eight electronic latches L1–L8, eleven resistors are R1–R11, eight diodes CR1–CR8, and ten light emitting diodes including diodes I210, I215, I317, I311, I315, I309, I325, I332, I326, and I305. The circuit is powered by a battery B.

Each of latches L1–L8 include a D or Data input, a G or gate input, and a Q or inverted Q output. As shown in FIG. 5, when the signal applied to the G input is low, the Q output will be in the inverse of the D input. When the signal applied to the G input is high the D input has no effect and the Q output is latched at the level it was at just prior to the application of the high signal to the G input. Resistors $R_1$–$R_9$ are pull-up resistors which insure that D and G inputs of latches L1–L8 are HI when switches S1–S10 are not activated.

Switches S1–S10 are specialty switches including an upper contact U, a middle contact M, and a lower contact L. The switches are preferable momentary contact switches. As the switches are depressed, the upper contact first makes a electrical contact with the middle contact and then the middle contact will make electrical contact with the lower contact, shorting the upper, middle, and lower contacts together. As the switch is released, the middle and lower contact break electrical contact first, and then the middle and upper contacts break electrical contact.

$R_1$ is connected to the lower contacts of switches S1–S10 and to all of the G inputs of L1–L8. R2 is connected to the middle contact of switch S7 and to the D in put of latch L6; $R_3$ is connected to the middle contact of switch S9 and to the D input of latch L7; $R_4$ is connected to the middle contact of switch S10 and to the D input of latch L8; $R_5$ is connected to the middle contact of switch S5 and to the D input of latch L5; $R_6$ is connected to the middle contacts of switches S3, S6 and to the D input of latch L3; $R_7$ is connected to the middle contacts of switches S4, S8 and to the D input of latch L4; $R_8$ is connected to the middle contact of switch S2 and to the D input of latch L2; and $R_9$ is connected to the middle contact of switch S1 and to the D input of latch L1.

The diodes are grouped into two groups labeled OR1 and OR2 in the figure. The diodes CR1–CR3 are coupled together to form the logical equivalent of a three input OR gate. Similarly, diodes CR4–CR8 are coupled together to create the logical equivalent of a five input OR gate. The output of OR gate OR1 is coupled to light emitting diode I210 and the output of OR gate OR2 is coupled to light emitting diode I215.

Light emitting diode I305–I332 are coupled to the Q outputs of the latches. Resistors R10–R11 are used to limit the current drawn by the various components of the device. Switch S11 is an off/on switch.

The operation of this second embodiment will be discussed in terms of a couple of hypothetical situations. When the device is first turned on a HI signal will be developed at the D input of each of latches L1–L8 via pull-up resistors R2–R9. Similarly, a HI level will be present at the G inputs for each of latches L1–L8 via resistor R1. Referring to FIG. 5, each of the Q outputs of latches L1–L8 will therefore retain the LO signal they had prior to the application of the HI signal to the G inputs of the latches. Thus, when the device is first turned on none of the LEDs are illuminated.

If, for example, switch S1 is actuated, the upper contact U will first make contact with the middle contact M, grounding the D input to latch L1. The middle contact M of S1 will then contact the lower contact L of S1 and to ground the G input of latches L1–L8. Referring again to FIG. 5, a LO signal on the D input and LO signal on the G input will develop a HI signal at the Q output of latch L1. Since the D input of latches L2–L8 are still HI, the Q output of those latches will still be LO. Thus, the closure of switch S1 will illuminate LED I210 and LED I315. As noted in FIG. 3 this corresponds to correct foot board and board marker for the foremost standing pin 1.

As switch S1 is released the middle M and the lower L contact of switch S1 will separate first causing a HI signal to be developed at the G input to latches L1–L8. This will cause the Q output of the latches to remain latched at their previous level, i.e. the Q output of L1 will be HI and Q outputs of L2–L8 will be LO. Next, the upper U and middle M contacts of switch S1 will separate and a HI signal will be developed at input D of latch L1. This HI signal level on input D will not affect the Q output of L1 since the G input is at a HI level. Thus, when switch S1 is depressed and released, LEDs I210 and I315 will remain illuminated indefinitely.

As a second operational example, assume that switch S6 is then momentarily actuated. This will first cause the D input of latch L3 to be grounded to a LO level, and will then develop a LO signal level on the G input to latches L1–L8. Since the D input to latch L1 is now HI the Q output of latch L1 will go LO. Similarly, the Q output of latches L2, and L4–L8 will be LO. The Q output of latch L3, however, will go HI illuminating LED I215 and LED I325. As noted in FIG. 3 these LEDs correspond to board marker 15 and foot board 25, respectively. Thus, the momentary actuation of one of switches S1–S10 will cancel the previous LED pattern and substitute a new LED pattern for it. This new LED pattern will remain on until another switch is subsequently actuated.

MICROCOMPUTER EMBODIMENTS:

FIGS. 6 illustrates an overview of a microcomputer-implemented bowling apparatus and system 700 of the invention. Its purpose relates to the continuous entry, analysis and generation in a positive manner of data to teach a bowler where to stand and aim on an actual upcoming shot at a bowling alley. In more detail, after the apparatus and system 700 has been initialized, input information is continuously entered by scanning of adjacent circuit elements, then analyzed to generated control signals, usually single-bit to show the bowler where to start his approach and where to aim up-alley toward the standing pins at the far end of the bowling alley.

As shown, microcomputer 701 of the apparatus and system 700 provides the integral key to operations of the invention by providing the means and manner to display, visual information to maximize pin count with minimum data entry problems. The microcomputer 701 operates under logic parameters and instructions that are many faceted, one segment of which relates to control bit signal generation corresponding the foremost, upalley standing pin. That control bit, is then used to control one of a series of latches 702 of a logic driver circuit 703. Either the latch output Q follows the input D or is held in a present state. When the control signal goes HI, all the latch outputs are held in a LO state. But as the control bit signal G from the microcomputer 701 goes LO through one of a first series of EXCLUSIVE-OR gates 704 and the individual input D goes LO through another series of EXCLUSIVE-OR gates 705, the output of the latches 702 goes HI and drives at least two LEDs of a LED array 706 from a source independent of the microcomputer 701. The LEDs that are enabled (selected), indicate correct aiming and foot positions for the bowler on his up-coming shot.

Inputs entered into the microcomputer 701 include right-or left-handness of the bowler via activation and scanning of closed contacts of switches 707 whereby in addition to gaining information for operation of the microcomputer 701, LED array 708 is also enabled as explained below from a source of current also independent of the microcomputer 701. Additional inputs are provided by having the microcomputer 701 continuously scan the closed contacts of a series of switches 709 associated with a particular group of standing pins whereby a similar set of information/enable operations, occurs. The series of switches 709 duplicates the position and number of the triangular pin grouping at an actual bowling alley as explained in more detail below.

The microcomputer 701 is preferable based on CMOS technology having at addressable port input- /output capability. An example is Texas Instruments TMS 1200 having the following operating characteristics:

ROM: 1024×8 bits,
RAM: 64×4 bits,
OUTPUTS: Port 1, 16 bit addressed, Port 2, 8 word addressed,
INPUTS: Port 3, 4 level+4,
SUBROUTINES: 3 level, any page
SUPPLY: 3-5 volts
PACKAGE: 40 pin The physical layout of the apparatus and system 700 of the invention is designed to present the generated data in a manner whereby the bowler can easily transfer that information to the actual circumstances he faces on the bowling alley.

FIGS. *7a*, *7b* and *7c* illustrates that layout in more detail.

As shown, the apparatus and system 700 includes an enclosure 600 for housing and/or supporting the microcomputer 701 and the associated circuit elements 702–710 of FIG. 6 (FIG. *7b*). The enclosure 600 is of rectangular cross-section and includes side walls 601, 602; end walls 603, 604; and top and rear walls 605, 606. Exterior top surface 607 of the wall 605 is provided with a series of indicia to mimic or replicate in scale, a bowling alley lane. Such indicia are generally indicated at 611, 612, 613, 614 and 615 in FIG. *7a*, and relate to the following:

(i) Symbols 611 are representations of the triangularly configured bowling pins 1, 2, 3 . . . 10, located at the far end the bowling lane, and (ii) Representations 612–615 illustrate the alley lane in plan view including the lane 612, the foul line 613, aiming board markers 614 ("spots") adjacent to the foul line 613 but on the pin side, and a series of foot positions 615 at the rear of approach area 616 that represents the starting point of the bowler's delivery of the bowling ball. The representations related to 611, 614 and 615 include separate I/0 elements driven by a source or sources of current independent of the microcomputer 701 to generate the visual data and achieve the features set forth below. Note also that the symbols 612 related, in general, to the alley lane includes a series of forty parallel lines 617 corresponding to the thirty-nine boards of an actual alley. The boards are counted from one to thirty-nine starting at the right of the lane as viewed and proceeding to the left.

Total I/O requirements of the present invention are as follows:

(a) Inputs entered into the microcomputer 701 includes a power-on switch 620 on side wall 602 of the enclosure 600 which also functions as a new game switch, keypads 621 of the switches 707 of FIG. 6 related to the right- or left-handness of the bowler and keypads 623 of the series of standing pin switches 709 of FIG. 6. The LEDs of arrays 708 and 710 of FIG. 6 are positioned within the keypads 623 and within transparent/opaque cover 622 to be easily visible to the bowler so he can crosscheck correctness of his data entries;

(b) Outputs generated by the microcomputer 701 of FIG. 6 include a series of bit control signals to control logic driver circuit 703 and indicate "correct" foot and aiming marker ("spot") positions on the bowling alley lane 612 for an up-coming shot. In this regard the above-mentioned LED arrays 706, 708 and 710 are positioned at different locations on the top surface 607 of enclosure 600, viz, in the keypads 623, covers 622 as previously mentioned and in surface 607 for direct association as symbols 614 and 615.

FIGS. 8*a* and 8*b* illustrates, in schematic form, the switches 709 and LEDs 710 of FIG. 6 (also shown on enclosure 600 at 611 in FIG. *7a*).

The switches 709 of FIG. 8*a* are each of double pole, single throw (DPST) construction. Mechanically, they are all lockable in the closed position by a spring-driven latching mechanism, not shown, conventional for such units.

Electrically, each of the switches 709 comprise two levels or sets of poles and two contact arms. At the first level (called the scanning level) each of the switches 709 includes pair of poles 640, 641 and swingable contact arm 642 pivotable about pole 640. As shown, each switch 709 is positioned at each cross point of a 3×4 matrix of switches. In the matrix, four (4) column conductors 643 connect to input terminals 644 for receiving the control bit signals $R_0..R_3$ from the microcomputer 701 of FIG. 6 to permit scanning of the switches 709 to indicate closure. Three (3) row conductors 645 include output terminals 646 connect to the $K_1..K_4$ input to the microcomputer as explained below. As the 3×4 matrix of switches 709 is scanned, closure of the individual switch is indicated by the code of the data $K_1..K_4$ that enters the microcomputer 701. That code indicates which of the pins are standing.

FIG. 8*b* illustrates the second level of operations of the switches 709 (called the indicating level) in which movement of the arms 642 in the first level of operations (FIG. 8*a*) is transferred to corresponding arms 642' (FIG. 8*b*) to enable a particular LED array 710 for illumination to cross-check the entry quality. As shown in FIG. 8*a* closure of an arm 642 is mechanically transferred via dotted lines 651 to also cause closure of arm 642' of FIG. 8*b* relative to its poles 640' and 641' in circuit between source 650, resistor 652 and common side or ground 653 of the source. In that way, current passes from the source 650 and through a particular LED in the array 710 to ground 653.

It should also be acknowledged that the right/left switches 707 of FIGS. 9*a* and 9*b* are each of DPST construction and operate in the same manner as described above. Electrically the switches 707 operate on two operating levels. At the first level (also called the scanning level) the closure of contact arms 655 is relative to poles 656 communicated to the microcomputer via signal $K_8$. The second level of operations (also called the indicating level) is as shown in FIG. 9*b* wherein closure of the arms 655 (FIG. 9*a*) is mechanically transferred via dotted lines 657 to arms 655'. The closure of arms 655' relative to poles 656' closes the circuit between source 658, resistor 659 and common side or ground 660 of the source 658. In that way current passes from the source 656 through a LED array 708. Note that in FIG. 9*a*, the parallel branches for scanning signal R4 are both interrogated by that signal but they do not contain the same elements. The right-hand branch is provided with a NOR gate 661 so that a LO signal (ZERO) into the microcomputer 701 via $K_8$, is always indicative of a right-handed bowler. A HI signal (ONE) indicates a left-handed bowler.

FIG. 10 is a schematic circuit diagram of the microcomputer 701. As shown, CPU 719 includes a power source 720, clock 721, instruction decoder 722, registers 723–728, ALU 729 and accumulator 730. Memory includes a ROM 731 and a RAM 732. I/Os comprises input buses 733, 734 for individual and latched inputs to the ALU 729. Output bus 735 is connected to R-latch/buffer 736 and to 0-output latches/PLA code convertor 737. The output of the bus 735 provides scanning strobe signals for scanning (i) the status of the left and right switches 707 of FIGS. 9*a*, 9*b* and (ii) the status of pin switches 709 of FIGS. 8*a* and 8*b*. In addition of the output of the bus 735 also provides control signals for logic driver circuit 703.

FIG. 11*a* and 11*b* show the logic driver circuit 703 in more detail. As shown, the circuit 703 includes a left-handed bowler's driver circuit 740 and a right-handed bowler's driver circuit 741. Circuits 740 and 741 are the same except that LED arrays 742 and 743 (FIG. 11*b*) are positioned at inverted board locations on the enclosure 600 of FIG. 6 in accordance with the table of FIG. 12. The positions of FIG. 12 are empirically derived. But associative quality of particular LEDs of the arrays 742, 743 is as shown in FIG. 11*b* where each LED is marked by board portions 5–35. Note positions of foremost standing pins 4 and 8 are duplicates, as are the positions of foremost pins 3 and 6.

The circuit 740 of FIG. 11*a* comprises two series of input EXCLUSIVE-OR gates 744, 745, and a series of latches 746. From the latches OR gates 747, 748 (FIG. 11*b*) connect to the LED array 742.

The circuit 741 of FIG. 11*a* is the same as circuit 740 and comprises EXCLUSIVE-OR gates 750, 751 and a series of latches 752. From the latches, OR gates 753, 754 (FIG. 11*b*) connect to the LED array 743. Each of the latches 746, 752 (FIG. 11*a*) includes a D or Data input, a G or gate input and a Q or inverted Q output. As shown, when the signal applied to the G input is LO, the Q output will be the inverse of the D input. When the signal applied to the G input is HI, the D input has no effect and the Q output is latched at the level it was at just prior to the application of the HI to the G input.

Each of the series of EXCLUSIVE-OR gates 744, 745, 750 and 751 (FIG. 111*a*) has two inputs and an output. When either input is HI, the output is HI. When neither or both inputs are HI, the output is LO. Thus, the EXCLUSIVE-OR gates 744, 745, 750 and 751 C provide via the data inputs D and G inputs G of latches 746, 752 operational output logic as set forth in FIG. 5. E.g., when the signal applied to the G input of latches 746, 752 is LO, the Q output is HI and a drive current I is latched to the arrays 742, 43 sourced independently from the microcomputer 701. When the G input is HI, the D input has no effect and the Q output is latched at the level it was just prior to the HI at the gate input G, viz, a LO.

OR gates 747, 748, 753 and 754 can be a series of diodes coupled together to form multi-input OR gate (3 or 5 inputs C each). When any one of the inputs is HI, the output is HI.

The operation and theory of the microcomputer apparatus and system 700 is as follows. First, the bowler enters his arm ("handness") preference via switches 707 of FIG. 6 the status of which is scanned and determined by the microcomputer 701. Next the bowler enters the number of the standing pins at the end of the alley via switches 709. As the switches 709 are scanned, the number and position is entered into the microcomputer 701 in the manner previously mentioned. Entry is visually cross-checked by the illuminated LEDs in array 710 as closure of certain of the switches 709 occurs. The microcomputer 701 next determines the up-alley, forestanding pin based on transformation logic say as provided using look-up logic as in indexed addressing instructions in the microcomputer 701. Transforming any pin group output into a foremost single standing pin, requires about one hundred seventy-five (175) separate storage locations of all group combinatior's indexed to new address locations associated with the foremost pin of each group.

For example, if all of the pins are standing, the foremost (nearest) standing pin is pin one, and if all but pins 7, 4 and 10 are standing, the microcomputer 701 designates the closest standing pin for the bowler is pin 4 and generates logic signals to indicate proper foot starting position and the proper aiming marker the bowler should aim to convert the configured pins based on pin 4. The relationship between the foremost pin, the foot board starting position, and the aiming marker are listed in the table of FIG. 12 and are a part of the programmed instructions within the microcomputer 701.

FIG. 13 is a flow chart for operations of the microcomputer-implemented bowling apparatus and system 700 of the invention. As shown, after all registers are reset at 800, the conditions at 801 are answered as to whether or not the bowler is right-handed. If the answer is affirmative by closing of one of the switches 707 (FIG. 6), the standing pin data is scanned and serially entered at 803. Then by look-up table logic such provided by indexed addressing instructions, the most up-alley standing pin is designated at 804, followed by generation of a single bit control signal associated with 805 to achieve the features of the invention set forth above. The algorithm for operations is in ROM 731 of FIG. 10 stepped through operations of instruction decoder 722 of the microcomputer 701. Then after the operation is repeated by iteration through entering another configuration of standing pins via loop 806.

A couple of examples illustrate the process steps in detail.

For example, when the logic driver circuit 703 of FIG. 11 is first powered on, there is no enable at the EXCLUSIVE-OR gates 744, 745, 750, 751. Hence the D and G inputs to each of the latches 746, 752 is HI. Referring the truth table of FIG. 5, each of the outputs of the latches 746, 752 retain the LO signal they had prior to the application of the HI signal to the G inputs. Thus, when the driver circuit 703 is first turned on, none of the LEDs of arrays 742, 743 is illuminated. Assume the bowler is right-handed so that right-hand circuit 741 is activated and the foremost standing pin is pin I, a bit enable signal at EXCLUSIVE-OR gate 750*a* generates a LO at the D input of associated latch 752*a*. The same signal at EXCLUSIVE-OR gate 751*a* generates a LO at the G input of the latch 752*a*. Referring again to FIG. 5, A LO signal on the D input and LO signal on the G input will develop a HI signal at the Q output of the latch. As a result, a drive current I sourced independently from the microcomputer enables LEDs 743*a* and 743*b*. When a new standing pin configuration is entered, the enables associated with pin 1 are terminated.

While the invention has been described in conjunction with preferred embodiments, it should be understood that various modifications within the scope of this invention can be made by one of ordinary skill in the art with departing from the spirit thereof. We therefore wish our invention to be defined by the scope of the appended claims as the prior art will permit and in view of the specification if need be.

What is claimed is:

1. A portable microcomputer-implemented apparatus and system for teaching bowling comprising:

(a) a viewing surface having a series of indicia representative of an actual bowling alley lane;

(b) a microcomputer supported adjacent to said viewing surface;

(c) viewable light emitting means supported adjacent to said viewing surface and said series of indicia in operative contact with said microcomputer;

(d) said light emitting means defining positions on said viewing surface corresponding to:

(i) at least a pair of board markers; and (ii) a series of start foot positions for a bowler on said actual bowling alley lane;

(e) switch means in scanning contact with said microcomptuer positioned adjacent to said viewing surface and having at least ten contact positions, each of said at least ten contact positions corresponding to one of ten bowling pin positions of said actual bowling alley lane; and (f) driver logic means in operative contact with and controllable by control signals generated by said microcomputer for selectively coupling said light emitting means to a drive current sourced independently from said microcomputer, said selective coupling being based on scanned closure of said at least ten positions of said switch means by said microcomputer to indicate correct foot and aim positions by said light emitting means to teach a bowler where to stand and aim to convert a particular standing pin configuration; and (g) said driver logic means includes a current source, first and second series of EXCLUSIVE-OR gates, each having first and second inputs and an output, and a series of latches each having a D input, a G input and a Q output to selectively activate said light emitting means with said drive current.

2. The apparatus and system of claim 1 in which said viewing surface includes a foul line, and parallel lines transverse to said foul line representing the position and number of boards comprising said actual bowling alley lane.

3. The apparatus and system of claim 1 in which aiming and foot positions are determined by said microcomputer based on transforming data related to said scanned closure of said at least ten positions of said switch means converting said scanning data that represents said particular standing pin configuration to a foremost standing pin position.

4. The apparatus and system of claim 1 in which said switch means includes two additional contact positions in scanning contact with said microcomputer for indicating left/right-handness whereby control signals generated by said microcomputer for control of said driver logic means are in accordance therewith.

5. The apparatus and system of claim 4 in which said two additional contact positions are each movable into contact with first and second terminals, a contact arm, a keypad operatively connected to said contact arm, a power source connected to said first terminal and a LED connected to said second terminal and to said keypad, said power source providing a drive current independent of said microcomputer to enable said LED and illuminate said keypad when said arm is positioned across said first and second terminals.

6. The apparatus and system of claim 1 in which said at least ten contact positions of said switch means are each movable into contact with first and second terminals, a contact arm, a keypad operatively connected to said arm, a power source connected to said first terminal and an LED connected to said second terminal and to said keypad, said power source providing a drive current independent of said microcomputer to enable said LED and illuminate said keypad when said arm contacts both terminals.

7. The apparatus and system of claim 1 in which said first and second inputs of said first and second series of EXCLUSIVE-OR gates are controlled by said micrcomputer and with said drive current, respectively, said outputs of said first series of EXCLUSIVE-OR gates being coupled to said D inputs of latches, said outputs of said second series of EXCLUSIVE-OR gates being coupled to said G inputs of said latches to activate said light emitting means.

8. The apparatus and systems of claim 1 wherein said light emitting means comprises a first and a second plurality of indicator lights, said first plurality of indicator lights includes a first pair of lights corresponding to boards 15 and 10 of said actual bowling alley lane, a second pair of lights corresponding to boards 25 and 30 of said actual bowling alley lane, and said second plurality of lights includes a first series of lights corresponding to boards 32, 25, 17, 15, 11, 9 and 5 of said actual bowling alley lane, and a second series of lights corresponding to boards 35, 31, 29, 25, 23, 16, 15 and 8 of said actual bowling alley lane.

9. The apparatus of claim 8 in which said lights are LEDS said first pair operates as part of said second series of LEDs.

10. An apparatus as in claim 1 wherein:

(a) said indicia includes a keypad array of symbols, each representing an individual pin, and said array being arranged to represent the array of pins of a bowling lane; and

(10) each said symbol encloses one of said ten switches and an LED that lights when said enclosed switch is closed.

* * * * *